US010913140B2

(12) United States Patent
Park et al.

(10) Patent No.: US 10,913,140 B2
(45) Date of Patent: Feb. 9, 2021

(54) MULTI-TOOL WITH QUICKLINK REMOVAL TOOL

(71) Applicant: Bell Sports, Inc., Scotts Valley, CA (US)

(72) Inventors: Stephen C. Park, San Jose, CA (US); Mark J. Matson, Santa Cruz, CA (US); Chi Cheung Foo, North Point (HK)

(73) Assignee: Bell Sports, Inc., Scotts Valley, CA (US)

( * ) Notice: Subject to any disclaimer, the term of this patent is extended or adjusted under 35 U.S.C. 154(b) by 229 days.

(21) Appl. No.: 16/040,500

(22) Filed: Jul. 19, 2018

(65) Prior Publication Data

US 2019/0061126 A1 Feb. 28, 2019

Related U.S. Application Data

(60) Provisional application No. 62/550,544, filed on Aug. 25, 2017.

(51) Int. Cl.
*B25B 27/00* (2006.01)
*B25B 27/22* (2006.01)
(Continued)

(52) U.S. Cl.
CPC ..... *B25B 27/0071* (2013.01); *B25B 13/48* (2013.01); *B25B 13/56* (2013.01);
(Continued)

(58) Field of Classification Search
CPC ..... B25B 27/007; B25B 27/22; B25B 13/48; B25B 13/56; B25B 15/008; B25B 1/04
(Continued)

(56) References Cited

U.S. PATENT DOCUMENTS 3,648,973 A 3/1972 Farrell
4,367,862 A * 1/1983 McGregor ..... B25B 27/22 24/68 CT
(Continued)

FOREIGN PATENT DOCUMENTS

DE 102004041885 3/2006
DE 202009014841 2/2010
(Continued)

OTHER PUBLICATIONS m19 Source: https://www.crankbrothers.com/tools_M19 Date Accessed: May 31, 2017.

*Primary Examiner* — Hadi Shakeri
(74) *Attorney, Agent, or Firm* — Walter M. Egbert, III; Gerard M. Donovan; Reed Smith LLP

(57) ABSTRACT

A bicycling multi-tool with a quicklink removal tool is disclosed. The quicklink tool includes a body having a first prong integral with the body and protruding in a first direction, and a first aperture proximate the first prong. The quicklink removal tool also includes a floating prong base having a second prong integral with the floating prong base and protruding in the first direction. The floating prong base includes a second aperture and a sliding face, and is slideably coupled to the body through a bolt passing through both the first aperture and the second aperture. The bolt is threadedly coupled to at least one of the first aperture and the second aperture. The face of the floating prong base is positioned proximate to and facing a sliding surface of the body. Turning the bolt drives the floating prong towards and away from the first prong.

17 Claims, 9 Drawing Sheets

(51) Int. Cl.

| | |
|---|---|
| ***B25F 1/04*** | (2006.01) |
| ***B25B 15/00*** | (2006.01) |
| ***B25B 13/48*** | (2006.01) |
| ***B25B 13/56*** | (2006.01) |

(52) U.S. Cl.
CPC ..... *B25B 15/008* (2013.01); *B25B 27/22* (2013.01); *B25F 1/04* (2013.01)

(58) Field of Classification Search
USPC ..... 7/138
See application file for complete search history.

(56) References Cited

U.S. PATENT DOCUMENTS

| | | | | |
|---|---|---|---|---|
| 4,394,810 | A | 7/1983 | Womble | |
| 5,305,667 | A * | 4/1994 | Caballero | B25B 13/00 7/138 |
| 5,970,553 | A * | 10/1999 | Lin | B25B 13/16 7/139 |
| 6,286,168 | B1 | 9/2001 | Woodruff et al. | |
| 6,574,817 | B2 * | 6/2003 | Wu | B25B 27/0071 7/118 |
| 6,637,061 | B1 | 10/2003 | Spracklin et al. | |
| 7,343,728 | B1 | 3/2008 | Cundari | |
| 8,555,609 | B1 * | 10/2013 | Chamberlain | B25B 27/0071 59/7 |
| 9,457,460 | B2 * | 10/2016 | Hermansen | B25F 1/02 |
| 10,408,301 | B2 * | 9/2019 | Lauer | B25B 27/0071 |
| 2005/0050642 | A1 | 3/2005 | Lee | |
| 2005/0204721 | A1 | 9/2005 | Wu | |
| 2006/0042428 | A1 | 3/2006 | Chuang | |
| 2011/0173759 | A1 | 7/2011 | Taiga | |
| 2012/0255273 | A1 | 10/2012 | Wang | |
| 2013/0263568 | A1 | 10/2013 | Chamberlain et al. | |

FOREIGN PATENT DOCUMENTS

| | | |
|---|---|---|
| DE | 202016104230 | 8/2016 |
| TW | M517033 U | 2/2016 |
| WO | 2017046093 | 3/2017 |

* cited by examiner

MULTI-TOOL WITH QUICKLINK REMOVAL TOOL

RELATED APPLICATIONS

This application claims the benefit of U.S. provisional patent application 62/550,544, filed Aug. 25, 2017 titled "Multi-Tool with Quicklink Removal Tool," the entirety of the disclosure of which is hereby incorporated by this reference.

TECHNICAL FIELD

Aspects of this document relate generally to bicycle multi-tools with a quicklink removal tool.

BACKGROUND

In the course of use, the chain of a bicycle is subjected to the strain of turning the geared wheel, in addition to the vibrations, jolts, and exposure to the elements inherent to bicycle riding. As a result, bicycle chains will occasionally break. A typical method for attaching two ends of a broken chain together is by using what is called a quicklink.

Quicklinks may be installed quickly and without the use of tools; the locking force is often applied by simply pressing on the pedal of the bicycle to pull the chain taut. However, the removal of a quicklink requires the use of a special tool to compress the link.

Trail and roadside repairs are often necessary. Although there are a variety of quicklink removal tools available, they are generally designed for use in a garage or workshop, and are sold individually with a primary, and sometimes only, functionality being that of removing a quicklink. Devoting that much space and weight to a single purpose tool whose necessity is irregular is not practical for a bike rider away from the workshop, where weight capacity and cargo space are at a premium.

SUMMARY

According to one aspect, a bicycling multi-tool may comprise a quicklink removal tool threadedly coupled to the multi-tool, wherein the quicklink removal tool may comprise a body comprising a fixed prong integral with the body and protruding from the body in a first direction, and a first aperture proximate the fixed prong, a floating prong base comprising a second prong integral with the floating prong base and protruding from the floating prong base in the first direction, the floating prong base comprising a second aperture and a sliding face, the floating prong base slideably coupled to the body through a bolt passing through both the first aperture and the second aperture, the bolt threadedly coupled to at least one of the first aperture and the second aperture, the face of the floating prong base positioned proximate to and facing a sliding surface of the body, a rotational tool sized and shaped to mate with a head of the bolt of the quicklink removal tool, a tool having a quicklink storage surface comprising at least two recesses, each recess shaped to receive a side and an integral post of a half of a quicklink, at least one screwdriver, a chainbreaker tool, and a plurality of hex head wrenches, wherein the quicklink removal tool is pivotally coupled to the multi-tool such, pivotable about an axis between a closed position and an open position, wherein turning the bolt drives the floating prong base towards and away from the fixed prong, wherein the sliding surface is part of a groove in the body of the quicklink removal tool in which the floating prong base is seated and along which the floating prong base slides as the bolt is turned, and wherein the bolt has a length between 1 cm and 4 cm.

Particular embodiments may comprise one or more of the following features. An interior surface of the fixed prong that faces the second prong is curved toward the second prong and an interior surface of the second prong that faces the fixed prong is curved toward the fixed prong, a distal end of the interior surface of the fixed prong being closer to a distal end of the interior surface of the second prong than a middle of the interior surface of the fixed prong is to a middle of the interior surface of the second prong. An exterior surface of the fixed prong that faces away from the second prong is curved away from the second prong and an exterior surface of the second prong that faces away from the fixed prong is curved away from the fixed prong, a distal end of the exterior surface of the fixed prong being further away from a distal end of the exterior surface of the second prong than a middle of the exterior surface of the fixed prong is to a middle of the exterior surface of the second prong.

According to an aspect, a bicycling multi-tool may comprise a quicklink removal tool releasably coupled to the multi-tool, wherein the quicklink removal tool may comprise a body comprising a first prong integral with the body and protruding from the body in a first direction, and a first aperture proximate the first prong, and a floating prong base comprising a second prong integral with the floating prong base and protruding from the floating prong base in the first direction, the floating prong base comprising a second aperture and a sliding face, the floating prong base slideably coupled to the body through a bolt passing through both the first aperture and the second aperture, the bolt threadedly coupled to at least one of the first aperture and the second aperture, the face of the floating prong base positioned proximate to and facing a sliding surface of the body, wherein turning the bolt drives the second prong towards and away from the first prong, and wherein the bolt has a length between 1 cm and 4 cm.

Particular embodiments may comprise one or more of the following features. At least one screwdriver and a plurality of hex head wrenches. A rotational tool, wherein the quicklink removal tool is threadedly coupled to the bicycling multi-tool, and wherein the bolt comprises a head sized and shaped to mate with the rotational tool. The quicklink removal tool may further comprise a chainbreaker tool. An interior surface of the first prong that faces the second prong is curved toward the second prong and an interior surface of the second prong that faces the first prong is curved toward the first prong, a distal end of the interior surface of the first prong being closer to a distal end of the interior surface of the second prong than a middle of the interior surface of the first prong is to a middle of the interior surface of the second prong. An exterior surface of the first prong that faces away from the second prong is curved away from the second prong and an exterior surface of the second prong that faces away from the first prong is curved away from the first prong, a distal end of the exterior surface of the first prong being further away from a distal end of the exterior surface of the second prong than a middle of the exterior surface of the first prong is to a middle of the exterior surface of the second prong. A tool having a quicklink storage surface comprising at least two recesses, each recess shaped to receive a side and an integral post of a half of a quicklink. The quicklink removal tool may be pivotally coupled to the multi-tool such, pivotable about an axis between a closed position and an open position. The first prong may comprise a first floating prong base, the first prong protruding from the first floating prong base in the first direction and comprising a first sliding face slidably coupled to the body through the bolt passing through the first aperture, the bolt comprising a dual threaded bolt, and wherein turning the bolt further drives the first prong towards and away from the second prong.

According to an aspect, a bicycling multi-tool may comprise a quicklink removal tool coupled to the multi-tool, wherein the quicklink removal tool may comprise a body comprising a first prong protruding from the body in a first direction, and a first aperture proximate the first prong, and a floating prong base comprising a second prong integral with the floating prong base and protruding from the floating prong base in the first direction, the floating prong base comprising a second aperture and a sliding face, the floating prong base slideably coupled to the body through a bolt passing through both the first aperture and the second aperture, the bolt threadedly coupled to at least one of the first aperture and the second aperture, the face of the floating prong base positioned proximate to and facing a sliding surface of the body, wherein turning the bolt drives the second prong towards and away from the first prong.

Particular embodiments may comprise one or more of the following features. The bolt may have a length between 1 cm and 4 cm. The quicklink removal tool may be releasably coupled to the multi-tool. At least one screwdriver and a plurality of hex head wrenches. The quicklink removal tool may further comprise a chainbreaker tool. A tool having a quicklink storage surface comprising at least two recesses, each recess shaped to receive a side and an integral post of a half of a quicklink. The quicklink removal tool may be pivotally coupled to the multi-tool such, pivotable about an axis between a closed position and an open position. The sliding surface may be part of a groove in the body of the quicklink removal tool in which the floating prong base is seated and along which the floating prong base slides as the bolt is turned.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶ 6. Thus, the use of the words "function," "means" or "step" in the Detailed Description or Description of the Drawings or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶ 6. Moreover, even if the provisions of 35 U.S.C. § 112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
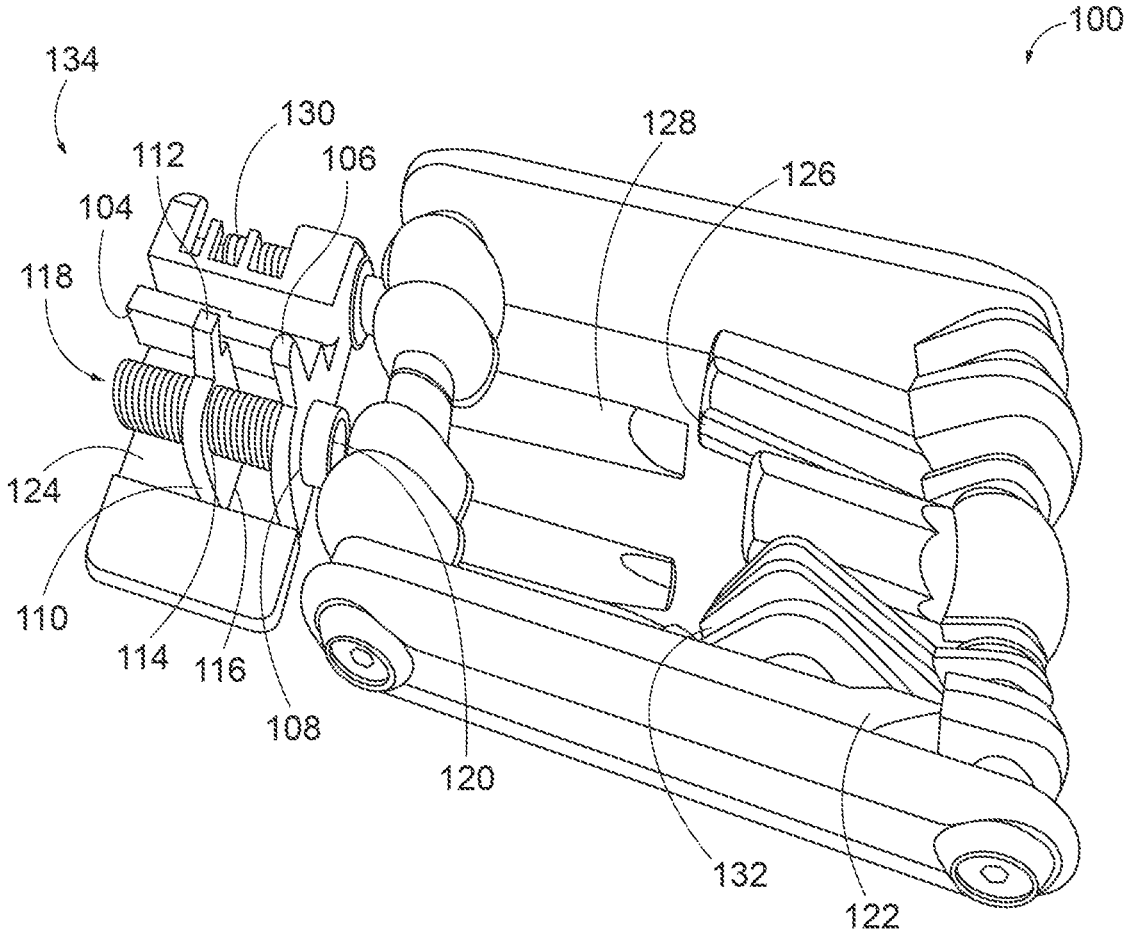
FIG. 1 is a perspective view of a bicycling multi-tool with a quicklink removal tool in an open position.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

In the course of use, the chain of a bicycle is subjected to the strain of turning the geared wheel, in addition to the vibrations, jolts, and exposure to the elements inherent to bicycle riding. As a result, bicycle chains will occasionally break. A typical method for attaching two ends of a broken chain together is by using a quicklink.

Figure 8:
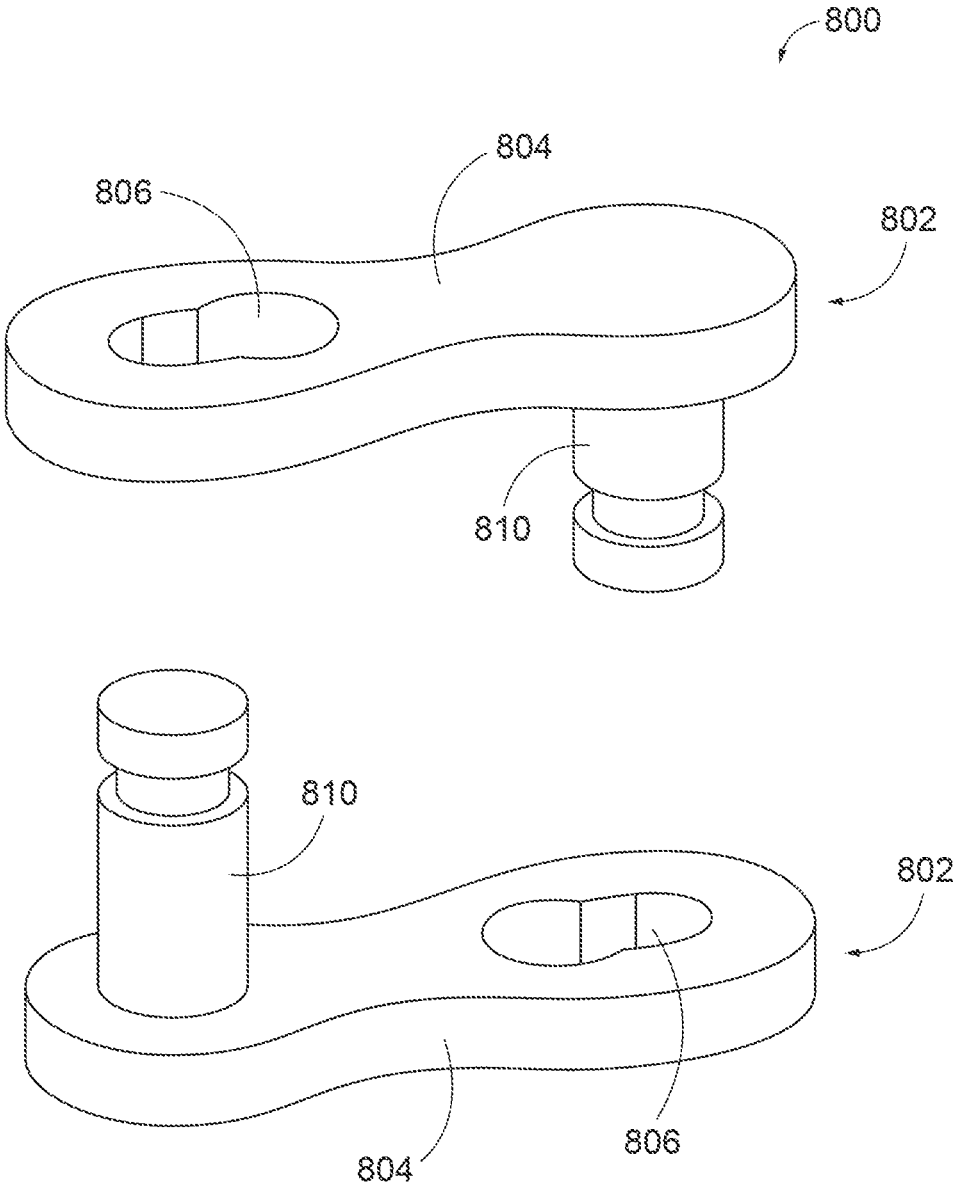
FIG. 8 (PRIOR ART)
FIG. 8 is an exploded view of a quicklink.

FIG. 8 shows an example of a quicklink 800. As shown, a quicklink 800 comprises of two halves 802, each half 802 having a side 804 with a post 806 and a slot 808. The post 806 is usually wider at the head than the body or neck. Typically, the end of the slot 806 near the middle of the quicklink side 804 is wide enough to receive a post head, and narrower than the post head at the distal end of the slot 808. The two halves 802 of a quicklink 800 join together, each receiving the post 806 of the other after the posts 806 pass through the apertures of the terminating links of the broken chain. To lock the quicklink halves 802 together, force is applied in the direction of the chain length, pulling the quicklink posts 806 away from each other and driving their bodies or necks into the narrow ends of the slots 808. Quicklinks 800 may be installed quickly and without the use of tools; the locking force is often applied by simply pressing on the pedal of the bicycle to pull the chain taut.

Unlike their installation, the removal of a quicklink 800 requires the use of a special tool to compress the link, pushing the posts 806 toward the middle such that posts 806 are in the wider end of the slots 808, and the sides 804 are offset from each other. Once unlocked, the quicklink halves 802 may be separated. Typical conventional quicklink removal tools resemble pliers.

Trail and roadside bicycle repairs are often necessary. Although there are a variety of quicklink removal tools available, they are mostly designed for use in a garage or workshop, and are typically sold individually with a primary, and sometimes only, functionality being that of removing a quicklink. Devoting that much space and weight to a single purpose tool whose necessity is irregular is not practical for a bike rider away from the workshop, where weight capacity and cargo space are at a premium.

Contemplated herein is a bicycle multi-tool having a compact quicklink removal tool. Most riders carry some form of small, bicycle-specific multi-tool to perform repairs when away from a workshop. The multi-tool contemplated herein comprises a compact quicklink removal tool that may be removed from the multi-tool and used to unlock an installed quicklink. The compact quicklink removal tool comprises two prongs that may be used to compress the posts of a quicklink together through the turning of a bolt. The compact quicklink removal tool does not substantially increase the size, weight, or profile of the multi-tool, allowing for roadside quicklink removal without having to carry any of the bulky, single-use tools conventionally used.

Figure 2:
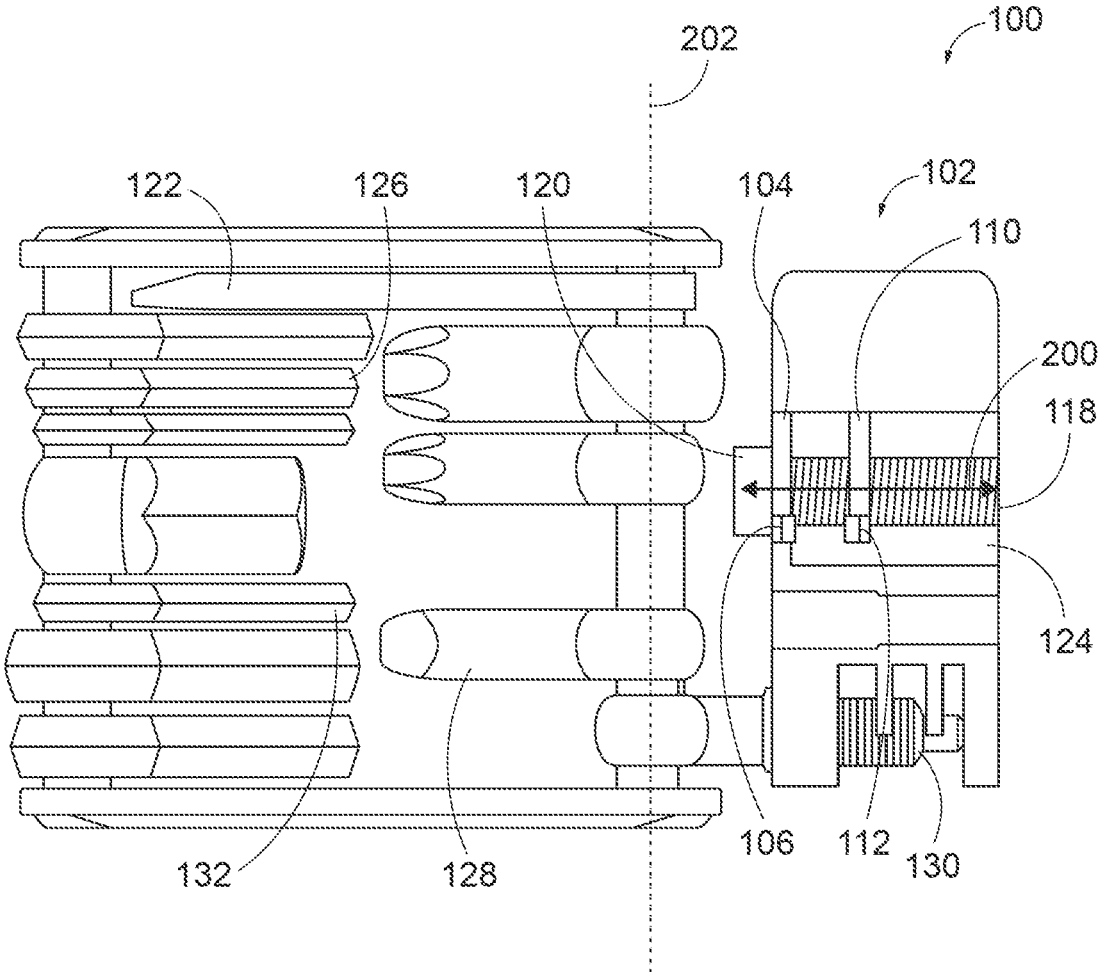
FIG. 2 is a top view of the bicycling multi-tool of FIG. 1.
Figure 3:
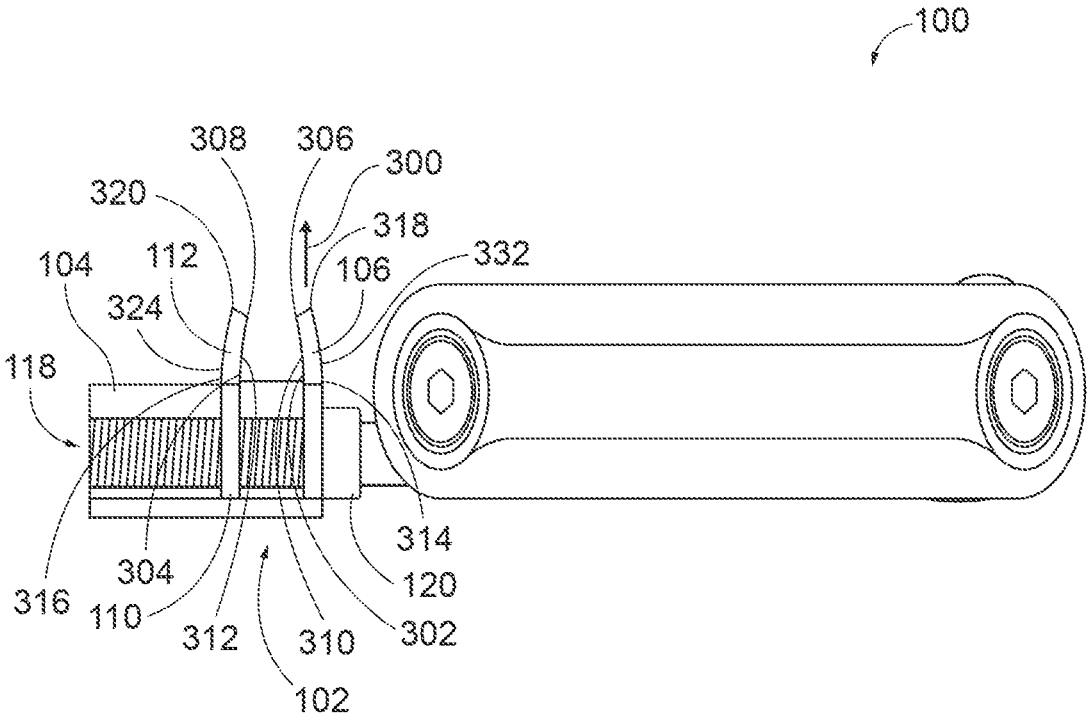
FIG. 3 is a side view of the bicycling multi-tool of FIG. 1.
Figure 4:
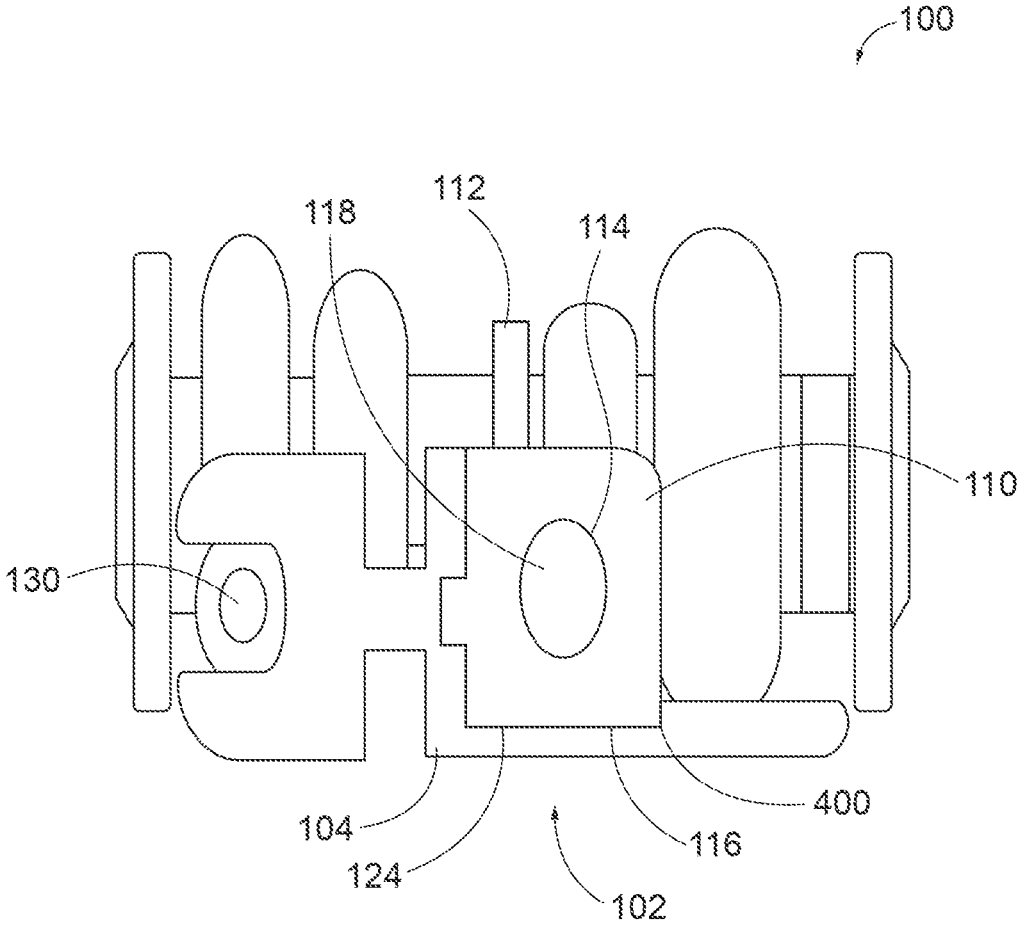
FIG. 4 is a end view of the bicycling multi-tool of FIG. 1.
Figure 5A:
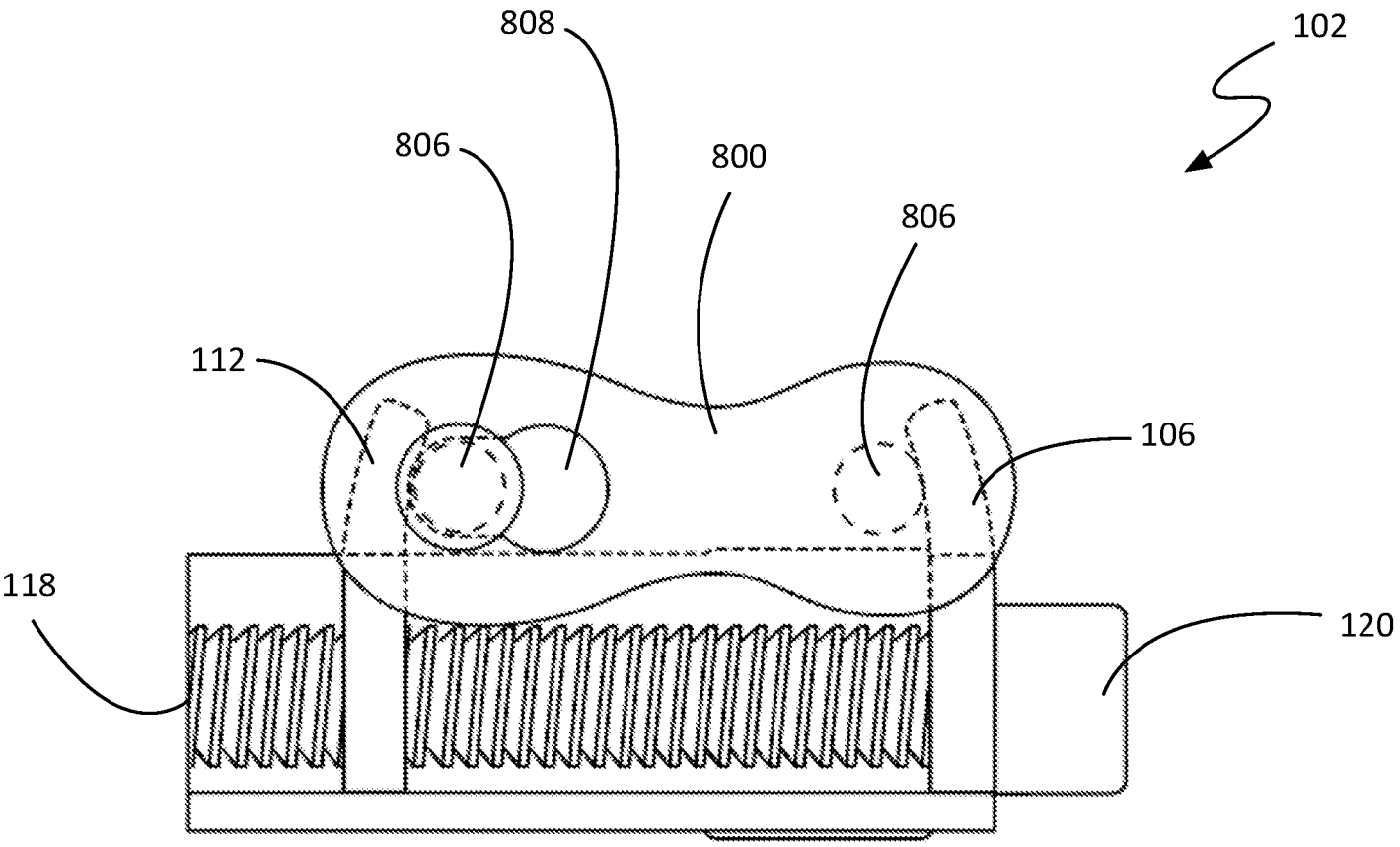
FIGS. 5A and 5B are close-up side views of a portion of a quicklink removal tool in operation.
Figure 5B:
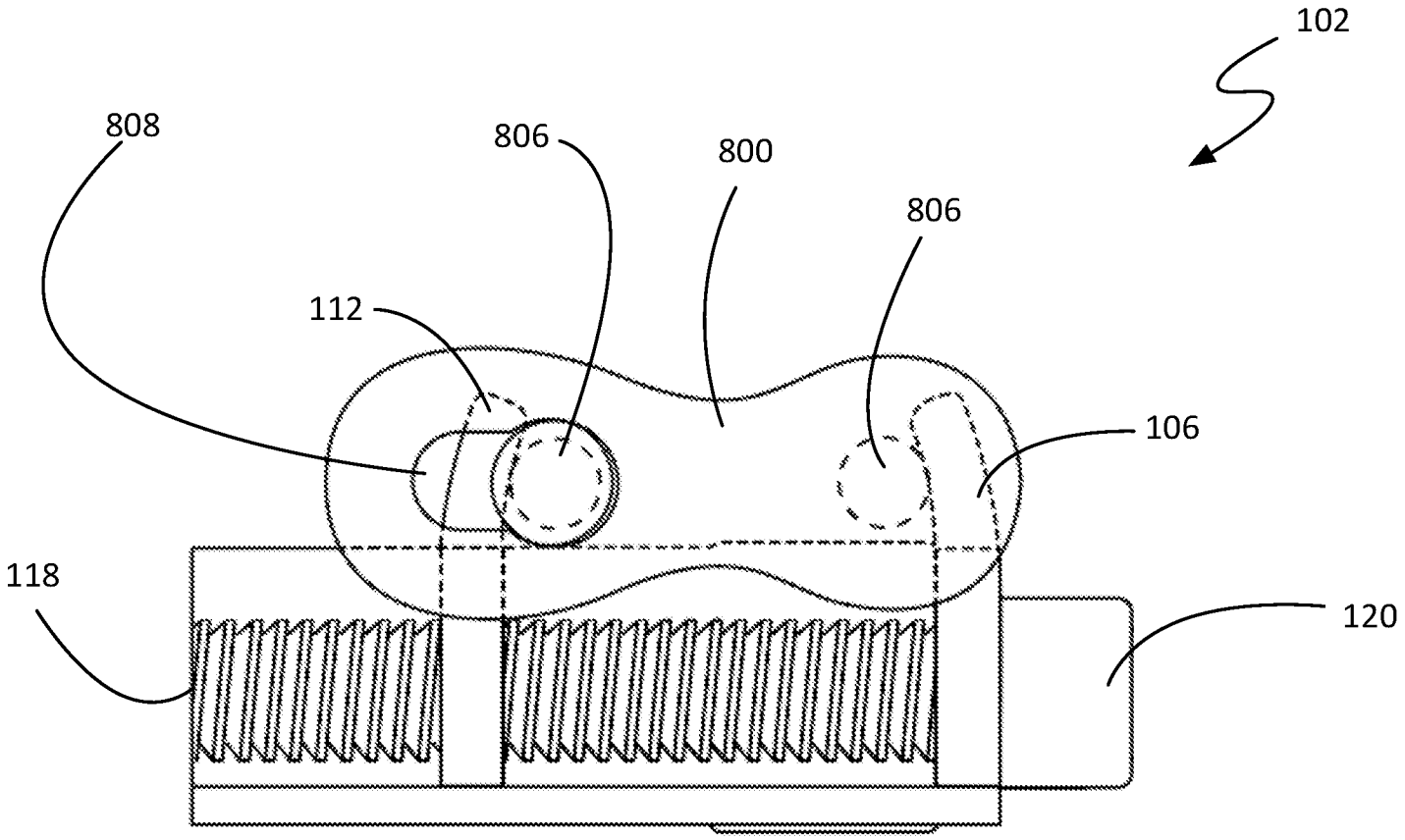

FIGS. 1-4 show various views of a non-limiting example of a bicycling multi-tool 100 with a quicklink removal tool 102 in an open position 134. Specifically, FIG. 1 is a perspective view of the multi-tool 100 in an open position 134, FIG. 2 is a top view, FIG. 3 is a side view, and FIG. 4 is an end view. FIGS. 5A and 5B are close-up views of a portion of the quicklink removal tool 102.

As shown, the quicklink removal tool 102 comprises a body 104 having a fixed prong 106, a floating prong base 110 with a second prong 112, and a bolt 118. The fixed prong 106 is integral with the body 104 of the quicklink removal tool 102. In the context of the present disclosure, floating means that the floating prong base 110 has the ability to move with respect to the fixed prong 106 and the quicklink tool body 104 while remaining coupled to the body 104; in this example through the bolt 118. Although fixed prong 106 is referenced as a fixed prong, it will be understood by those of ordinary skill in the art that in some embodiments the fixed prong 106 may also be a floating prong if the bolt 118 is replaced with a dual side threaded bolt with threads going in both directions so that when it is twisted in a first direction, the two floating prongs attached to the bolt will move apart from each other and when the bolt is twisted in a second direction, the two floating prongs attached to the bolt will move closer to each other. Thus, where the fixed prong 106 is discussed herein, unless the description requires a fixed component, the description is intended to apply to a first floating prong 106.

As the bolt 118 is turned, the floating prong base 110 is driven towards or away from the fixed prong 106, depending on the direction the bolt 118 is turned in. In some embodiments, the head 120 of the bolt 118 may be compatible with (i.e. sized and shaped to mate with) a rotational tool 126 such as a wrench or other tool present on the multi-tool 100. As a specific example, the bolt 118 may be turned with a 4 mm hex head wrench. In other embodiments, the head 120 of the bolt 118 may be knurled, to provide grip for manually turning the bolt with fingers. The hex head wrench, such as an Allen wrench or other brand hex head wrench, or other turning tool may be included on the multi-tool 100.

According to various embodiments, the bolt 118 passes through a first aperture 108 in the body 104, as well as a second aperture 114 in the floating prong base 110. As shown, the first aperture 108 may be aligned with the first, or fixed, prong 106. In some embodiments, including the non-limiting example shown in FIGS. 1-5, the first aperture 108 of the body 104 may be unthreaded, allowing the bolt 118 to turn in place, and the second aperture 114 of the floating prong base 110 may be threaded such that when the bolt 118 is turned, the floating prong body 110 moves linearly along the bolt 118.

In other embodiments, the first aperture 108 in the body 104 may be threaded, such that turning the bolt 118 causes the bolt 118 to move in or out of the quicklink tool body 104. The floating prong base 110 (and thus, the second prong 112) may be rotatably coupled to the bolt 118, such that it moves linearly along its rotational axis with respect to the fixed prong 106 as the bolt 118 moves in or out of the first aperture 108.

FIG. 2 shows a top view of the bicycling multi-tool 100 of FIG. 1, and FIG. 4 shows an end view of the same. As shown, the floating prong base 110 is restricted from rotating as the bolt 118 is turned due to its proximity to surfaces of the body 104 of the quicklink removal tool 102, forcing it to thread up or down the bolt 118, moving towards or away from the fixed prong 106.

According to various embodiments, the floating prong base 110 has at least one sliding face 116 that is positioned proximate to and facing a sliding surface 124 of the body 104. Such an interface provides stability as well as restricts the rotation of the floating prong base 110 with respect to the body 104.

As shown in FIG. 4, the floating prong base 110 may fit into, and slide along, a groove 400 (e.g. a track, notch, slot, etc.) in the body 104 that comprises a sliding surface 124. The groove 400 provides stability and prevents rotation of the floating prong base 110.

The range of motion of the floating prong base 110 with respect to the fixed prong 106 is bounded, at the least, by the length 200 of the bolt 118. According to various embodiments, the quicklink removal tool 102 is sized such that it may be used to remove a quicklink 800 while still being able to be incorporated into a bicycling multi-tool 100. In some embodiments, the bolt 118 may range in length 200 between 1 cm and 2 cm. In other embodiments, the bolt length 200 may range between 1 cm and 2.5 cm, in other embodiments, the bolt length 200 may range between 1 cm and 3 cm, and in still other embodiments, the bolt length 200 may range between 1 cm and 4 cm, each length range having its own particular advantage and application. The length 200 of the bolt 118 used may depend upon the size and shape of the body 104 and/or floating prong base 110 that it is being used with.

FIG. 3 is a side view of the bicycling multi-tool 100 of FIG. 1 with the quicklink removal tool 102 in an open position 134. As shown, both the fixed prong 106 and the second, or floating, prong 112 are protruding away from the tool 102 in the first direction 300, or they are at least protruding in that same direction close to the body 104/base 110 with which they are integral. The prongs of the quicklink removal tool 102 engage with the posts 806 of a quicklink 800 as part of the removal process, as will be discussed in greater detail with respect to FIGS. 5A and 5B.

As shown in FIG. 3, these two prongs are not straight, but rather have a slight curvature. According to various embodiments, the fixed prong 106 and/or the second prong 112 may be slightly curved to provide a mechanical engagement as it captures the quicklink 800 and restricts it from slipping up and out of the tool 102 as the bolt 118 is turned. More specifically, according to various embodiments, the interior surface 302 of the fixed prong 106 that faces the second prong 112 is curved toward the second prong 112 and the interior surface 304 of the second prong 112 that faces the fixed prong 106 is curved toward the fixed prong 106, such that the distal (e.g. terminating, etc.) end 306 of the interior surface 302 of the fixed prong 106 is closer to the distal end 308 of the interior surface 304 of the second prong 112 than the middle 310 of the interior surface 302 of the fixed prong 106 is to the middle 312 of the interior surface 304 of the second prong 112.

In some embodiments, the prongs may be similarly curved in the opposite direction on their outside edges as well, allowing the tool 102 to be used to install a quicklink 800 by putting the two prongs between the two quicklink posts 806 and turning the bolt 118 to spread the prongs apart until the posts 806 engage the narrow end of the slots 808.

Specifically, in some embodiments, the exterior surface 314 of the fixed prong 106 that faces away from the second prong 112 is curved away from the second prong 112 and the exterior surface 316 of the second prong 112 that faces away from the fixed prong 106 is curved away from the fixed prong 106, such that the distal end 318 of the exterior surface 314 of the fixed prong 106 is further away from the distal end 320 of the exterior surface 316 of the second prong 112 than the middle 322 of the exterior surface 314 of the fixed prong 106 is to the middle 324 of the exterior surface 316 of the second prong 112. Of course, since a tool is not explicitly required to install a quicklink 800, the prongs of other embodiments may not curve outward in such a fashion, and in other embodiments the prongs may not curve at all and may be straight.

FIGS. 5A and 5B are close-up side views of a detached quicklink removal tool 102 in operation. As shown in FIG. 5A, the bolt 118 has been turned, moving the floating prong base 110 and the integral second prong 112 far enough away from the fixed prong 106 that the posts 806 of a quicklink 800 can be placed between the two prongs.

FIG. 5B shows the results achieved by turning the bolt 118. As the bolt 118 is turned, the floating prong base 110 and the integral second prong 112 are driven towards the fixed prong 106, squeezing the posts 806 of the quicklink 800 towards each other until they have been driven to the wide end of the slots 808, where the posts 806 are able to slide out of the slot 808 allowing the quicklink 800 to be separated into halves 802, removing the posts 806 from the neighboring chain links (not shown). The flat surface of the body 104 (see FIG. 4) may advantageously make the tool 102 easier to hold while turning the bolt 118 with a tool 126.

Figure 6:
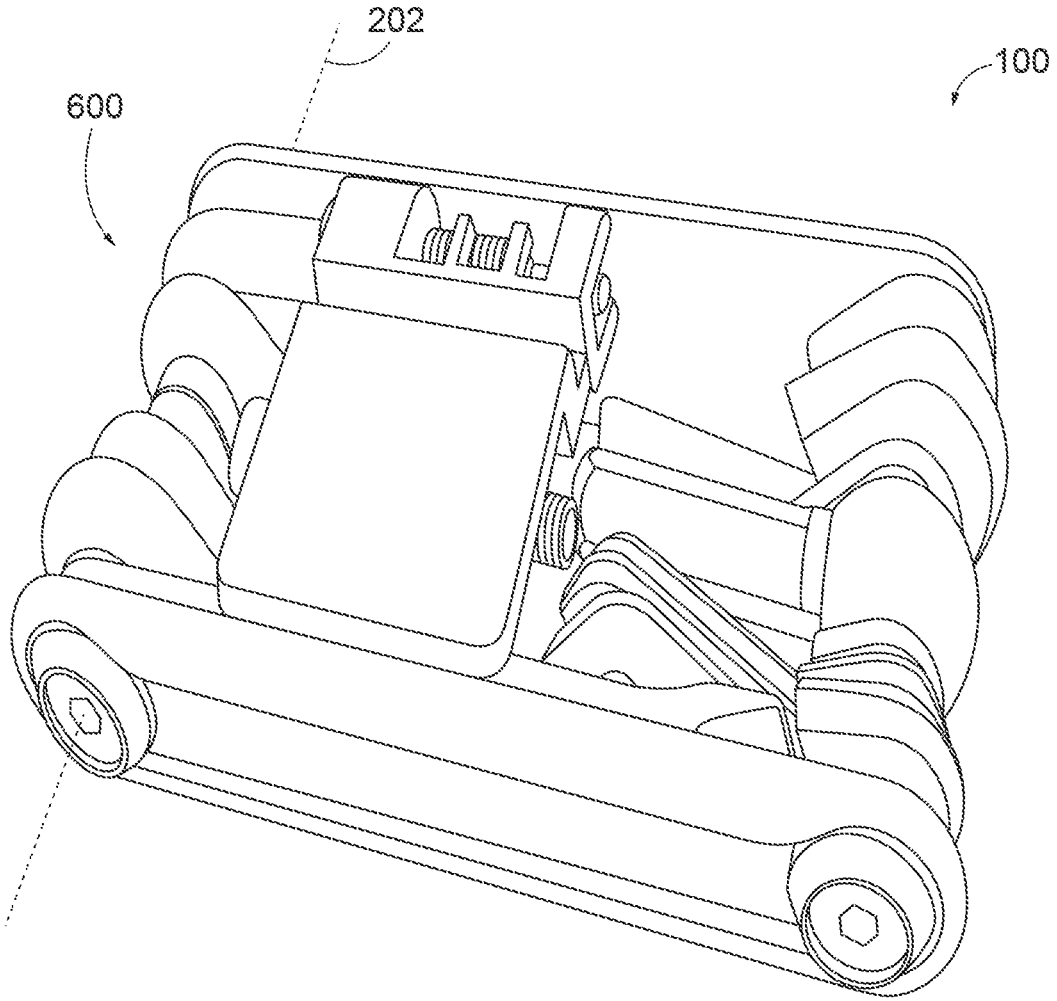
FIG. 6 is a perspective view of the bicycling multi-tool of FIG. 1 with the quicklink removal tool in a closed position.

According to various embodiments, the quicklink removal tool 102 is pivotally coupled to the multi-tool 100 such that it can pivot between an open position 134 (see FIG. 1) and a closed position. FIG. 6 shows a perspective view of the multi-tool 100 of FIG. 1 in a closed position 600. In some embodiments, including the one shown in FIG. 6, the quicklink removal tool 102 may pivot on an axis 202 on which other tools of the multi-tool 100 pivot. In other embodiments, the quicklink removal tool 102 may pivot with respect to the multi-tool 100 on an axis that is unique to the quicklink removal tool 102.

In other embodiments, the quicklink removal tool 102 may be deployed for use through a different mechanism, such as sliding, twisting, or any other known in the art. Furthermore, it should be clear to one skilled in the art that the quicklink removal tool 102 contemplated herein may be incorporated with a variety of multi-tools, and may be adapted for use as part of any bicycle multi-tool known in the art.

According to various embodiments, the quicklink removal tool 102 may be located on one side of the multi-tool 100, and may rest in a plane perpendicular to the fold out path of other tools. In FIG. 6, the quicklink removal tool 102 may be seen folded over a plurality of other tools. Such a positioning may allow for the incorporation of the quicklink removal tool 102 into a multi-tool 100 without substantial change to the multi-tools dimensions.

In some embodiments, the quicklink removal tool 102 may be built into another tool on the multi-tool 100. For example, as shown in FIG. 1, the compact quicklink removal tool 102 may be built into the side of a chainbreaker tool 130, and may be integrated into the multi-tool as another element that can fold out for use. In other embodiments, the quicklink removal tool 102 may be part of a different element of the multi-tool, or may be attached to the multi-tool by itself.

According to various embodiments, the quicklink removal tool 102 may be releasably coupled to the multi-tool 100. Detaching the quicklink tool from the multi-tool may facilitate its use on a chain that is still attached to a bicycle, and make the operation itself easier. For instance, detaching the quicklink removal tool 102 would allow the head 120 of the bolt 118 to be rotated using another tool 126 on the multi-tool 100, giving the user additional torque and making the quicklink removal process easier.

In some embodiments, the quicklink removal tool 102 may be threadedly coupled to the multi-tool 100. For instance, in the non-limiting example shown in FIG. 1, the quicklink removal tool 102 may be removed from the multi-tool 100 by unthreading the chainbreaker 130 to which it is coupled. In other embodiments, the quicklink tool 102 may be releasably coupled to the multi-tool 100 via an attachment that is threaded, magnetic, friction based, snapping, or any other releasable attachment known in the art. In other embodiments, the quicklink tool 102 may be permanently coupled to the multi-tool, and may be operated with a tool, such as a wrench, that is independent from, or detachable from, the multi-tool 100.

As shown, the bicycling multi-tool 100 may comprise a number of additional tools, including a chainbreaker 130, one or more screwdrivers 128, a rotational tool 126 configured for use with the head 120 of the bolt 118 of the quicklink removal tool 102, a plurality of hex head wrenches 132, and/or any other tools known in the art to be needed while away from a garage or workshop and able to be incorporated into a multi-tool.

FIG. 1 shows a non-limiting example of a quicklink removal tool 102 that is coupled to a chainbreaker tool 130. Integrating the quicklink removal tool 102 with the chainbreaker tool 130 is advantageous, as the chainbreaker tool 130 is attached to the multi-tool 100 through the threaded bolt that, when turned, is used to push the pin out of a chain link coupling. Advantageously, the chainbreaker 130 body (and the attached quicklink removal tool 102) may be uncoupled from the rest of the multi-tool 100 by unthreading the chainbreaker 130.

In some embodiments, the multi-tool 100 may also comprise replacement quicklink parts. Quicklink halves 802 are small, easy to lose in a bike bag, and may be hard to find when needed. Storing replacement quicklink 800 parts in a recessed tool on the multi-tool 100 makes them conveniently on hand if the quicklink removal tool 102 is ever needed. According to various embodiments, the quicklink parts may be stored in the recessed surface of another tool, without interfering with its use.

Figure 7:
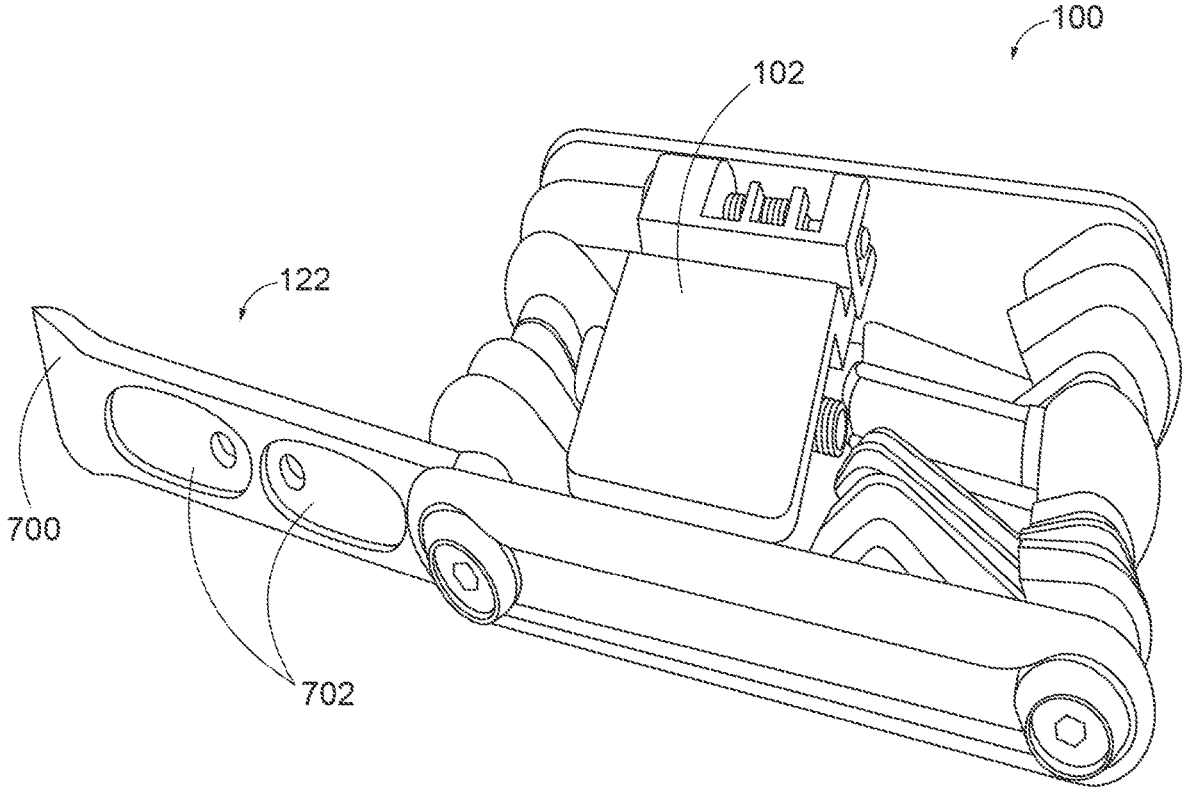
FIG. 7 is a perspective view of the bicycling multi-tool of FIG. 1 with a quicklink storage tool in an open position.

FIG. 7 shows a non-limiting example of a tool 122 (in this case, an elongated, wedge-shaped tool used for prying) comprising a quicklink storage surface 700. FIG. 7 shows the tool 122 in an open position. In the context of the present description and the claims that follow, a quicklink storage surface 700 is a surface that has recesses shaped to receive the parts of one or more quicklinks 800. For example, in some embodiments, the storage surface 700 may comprise two recesses 702 each shaped to receive a side 804 and integral post 806 of half 802 of a quicklink 800. Other embodiments may comprise more recesses, while still other embodiments may store quicklink components in another fashion (e.g. a closeable container integrated into the multi-tool, etc.).

According to various embodiments, the quicklink removal tool 102 may be sized (e.g. the bolt 118 and body 104 may be sized) such that it may be used with a variety of bicycle chain sizes, and may be incorporated with a traditional multi-tool without significantly changing the overall dimensions of the tool. Furthermore, the quicklink removal tool 102 may be composed of metal, thermoplastic, or any other material known in the art for construction of bicycle tools, particularly bicycle multi-tool elements.

Where the above examples, embodiments and implementations reference examples, it should be understood by those of ordinary skill in the art that other tools and multi-tools could be intermixed or substituted with those provided. In places where the description above refers to particular embodiments of multi-tools and quicklink removal tools, it should be readily apparent that a number of modifications may be made without departing from the spirit thereof and that these embodiments and implementations may be applied to other to multi-tools as well. Accordingly, the disclosed subject matter is intended to embrace all such alterations, modifications and variations that fall within the spirit and scope of the disclosure and the knowledge of one of ordinary skill in the art.

What is claimed is:

1. A bicycling multi-tool, comprising:

a first bolt pivotal about an axis;

a quicklink removal tool comprising:

a body comprising a fixed prong integral with the body and protruding from the body in a first direction, and a first aperture proximate the fixed prong; and a floating prong base comprising a second prong integral with the floating prong base and protruding from the floating prong base in the first direction, the floating prong base comprising a second aperture and a first sliding face, the floating prong base slideably coupled to the body through a second bolt passing through both the first aperture and the second aperture, the second bolt threadedly coupled to at least one of the first aperture and the second aperture, the first sliding face of the floating prong base positioned proximate to and facing a second sliding surface of the body;

a rotational tool sized and shaped to mate with a head of the second bolt of the quicklink removal tool;

a tool having a quicklink storage surface comprising at least two recesses, each recess shaped to receive a side and an integral post of a half of a quicklink;

at least one screwdriver;

a chainbreaker tool integral with the quick removal tool and threadedly receiving the first bolt therein, wherein the chainbreaker tool and quicklink removal tool are adapted to be uncoupled from the multitool by unthreading the chainbreaker from the first bolt; and wherein the first bolt received within the chainbreaker tool is configured to advance a pin of a chain link coupling; and a plurality of hex head wrenches;

wherein the quicklink removal tool is pivotally coupled to the multi-tool such, pivotable about an axis between a closed position and an open position;

wherein turning the bolt drives the floating prong base towards and away from the fixed prong;

wherein the second sliding surface is part of a groove in the body of the quicklink removal tool in which the floating prong base is seated and along which the floating prong base slides as the bolt is turned; and wherein the second bolt has a length between 1 cm and 4 cm.

2. The bicycling multi-tool of claim 1, wherein an interior surface of the fixed prong that faces the second prong is curved toward the second prong and an interior surface of the second prong that faces the fixed prong is curved toward the fixed prong, a distal end of the interior surface of the fixed prong being closer to a distal end of the interior surface of the second prong than a middle of the interior surface of the fixed prong is to a middle of the interior surface of the second prong.

3. The bicycling multi-tool of claim 2, wherein an exterior surface of the fixed prong that faces away from the second prong is curved away from the second prong and an exterior surface of the second prong that faces away from the fixed prong is curved away from the fixed prong, a distal end of the exterior surface of the fixed prong being further away from a distal end of the exterior surface of the second prong than a middle of the exterior surface of the fixed prong is to a middle of the exterior surface of the second prong.

4. A bicycling multi-tool, comprising:

one or more tools and a first bolt pivotal about an axis;

a quicklink removal tool comprising:

a body comprising a first prong integral with the body and protruding from the body in a first direction, and a first aperture proximate the first prong; and a floating prong base comprising a second prong integral with the floating prong base and protruding from the floating prong base in the first direction, the floating prong base comprising a second aperture and a first sliding face, the floating prong base slideably coupled to the body through a second bolt passing through both the first aperture and the second aperture, the second bolt threadedly coupled to at least one of the first aperture and the second aperture, the first sliding face of the floating prong base positioned proximate to and facing a second sliding surface of the body;

wherein turning the second bolt drives the second prong towards and away from the first prong; and wherein the second bolt has a length between 1 cm and 4 cm; and a chainbreaker tool integral with the quick removal tool and threadedly receiving the first bolt therein, wherein the chainbreaker tool and quicklink removal tool are adapted to be uncoupled from the multitool by unthreading the chainbreaker from the first bolt; and wherein the first bolt received within the chainbreaker tool is configured to advance a pin of a chain link coupling.

5. The bicycling multi-tool of claim 4, further comprising at least one screwdriver and a plurality of hex head wrenches.

6. The bicycling multi-tool of claim 4, further comprising a rotational tool, wherein the second bolt comprises a head sized and shaped to mate with the rotational tool.

7. The bicycling multi-tool of claim 4, wherein an interior surface of the first prong that faces the second prong is curved toward the second prong and an interior surface of the second prong that faces the first prong is curved toward the first prong, a distal end of the interior surface of the first prong being closer to a distal end of the interior surface of the second prong than a middle of the interior surface of the first prong is to a middle of the interior surface of the second prong.

8. The bicycling multi-tool of claim 7, wherein an exterior surface of the first prong that faces away from the second prong is curved away from the second prong and an exterior surface of the second prong that faces away from the first prong is curved away from the first prong, a distal end of the exterior surface of the first prong being further away from a distal end of the exterior surface of the second prong than a middle of the exterior surface of the first prong is to a middle of the exterior surface of the second prong.

9. The bicycling multi-tool of claim 4, further comprising a tool having a quicklink storage surface comprising at least two recesses, each recess shaped to receive a side and an integral post of a half of a quicklink.

10. The bicycling multi-tool of claim 4, wherein the chain breaker tool and the quicklink removal tool is pivotally coupled to the multi-tool via the first bolt, and pivotable about the axis between a closed position and an open position.

11. The bicycling multi-tool of claim 4, wherein the first prong comprises a first floating prong base, the first prong protruding from the first floating prong base in the first direction and comprising a first sliding face slidably coupled to the body through the bolt passing through the first aperture, the bolt comprising a dual threaded bolt, and wherein turning the bolt further drives the first prong towards and away from the second prong.

12. A bicycling multi-tool, comprising:

one or more tools and a first bolt pivotal about an axis;

a quicklink removal tool comprising:

a body comprising a first prong protruding from the body in a first direction, and a first aperture proximate the first prong; and a floating prong base comprising a second prong integral with the floating prong base and protruding from the floating prong base in the first direction, the floating prong base comprising a second aperture and a first sliding face, the floating prong base slideably coupled to the body through a second bolt passing through both the first aperture and the second aperture, the second bolt threadedly coupled to at least one of the first aperture and the second aperture, the first sliding face of the floating prong base positioned proximate to and facing a second sliding surface of the body;

wherein turning the second bolt drives the second prong towards and away from the first prong; and, a chainbreaker tool integral with the quick removal tool and threadedly receiving the first bolt therein, wherein the chainbreaker tool and quicklink removal tool are adapted to be uncoupled from the multitool by unthreading the chainbreaker from the first bolt; and wherein the first bolt received within the chainbreaker tool is configured to advance a pin of a chain link coupling.

13. The bicycling multi-tool of claim 12, wherein the second bolt has a length between 1 cm and 4 cm.

14. The bicycling multi-tool of claim 12, further comprising at least one screwdriver and a plurality of hex head wrenches.

15. The bicycling multi-tool of claim 12, further comprising a tool having a quicklink storage surface comprising at least two recesses, each recess shaped to receive a side and an integral post of a half of a quicklink.

16. The bicycling multi-tool of claim 12, wherein the quicklink removal tool is pivotally coupled to the multi-tool such, pivotable about an axis between a closed position and an open position.

17. The bicycling multi-tool of claim 12, wherein the second sliding surface is part of a groove in the body of the quicklink removal tool in which the floating prong base is seated and along which the floating prong base slides as the bolt is turned.

* * * * *